United States Patent [19]

Hazaki

[11] Patent Number: 4,502,852

[45] Date of Patent: Mar. 5, 1985

[54] OIL FEEDING DEVICE FOR SCROLL FLUID APPARATUS

[75] Inventor: Eiichi Hazaki, Shimizu, Japan

[73] Assignee: Hitachi, Ltd., Tokyo, Japan

[21] Appl. No.: 366,310

[22] Filed: Apr. 7, 1982

[30] Foreign Application Priority Data

Apr. 17, 1981 [JP] Japan ..... 56-57151

[51] Int. Cl.[3] ..... F01C 1/02; F01C 21/04

[52] U.S. Cl. ..... 418/55; 418/94

[58] Field of Search ..... 418/55, 94

[56] References Cited

U.S. PATENT DOCUMENTS

| | | | |
|---|---|---|---|
| 3,848,702 | 11/1974 | Bergman | 418/94 X |
| 4,065,279 | 12/1977 | McCullough | 418/55 X |
| 4,216,661 | 8/1980 | Tojo et al. | 418/55 X |
| 4,343,599 | 8/1982 | Kousokabe | 418/55 |

FOREIGN PATENT DOCUMENTS

| | | | |
|---|---|---|---|
| 55-43217 | 3/1980 | Japan | 418/55 |
| 55-46081 | 3/1980 | Japan | 418/55 |

*Primary Examiner*—John J. Vrablik
*Assistant Examiner*—T. Olds
*Attorney, Agent, or Firm*—Antonelli, Terry & Wands

[57] ABSTRACT

Oil feeding device for feeding lubricant oil to bearings journalling a crank shaft connected to an orbiting scroll member of scroll fluid apparatus including recessed oil flow passages formed on the outer peripheral surface of the crank shaft in positions corresponding to a first plain bearing journalling a crank portion of the crank shaft and second and third plain bearings for journalling a shaft portion of the crank shaft respectively. The oil flow passage for the third plain bearing offers a lower resistance to the flow of fluid than the oil flow passages for the first and second plain bearings, to thereby avoid wear and seizure of the bearings.

4 Claims, 6 Drawing Figures

OIL FEEDING DEVICE FOR SCROLL FLUID APPARATUS

BACKGROUND OF THE INVENTION

This invention relates to scroll fluid apparatus suitable for use as a compressor, expander or liquid pump, and, more particularly, to an oil feeding device for such scroll fluid apparatus.

A scroll fluid apparatus is disclosed, for example, in U.S. Pat. No. 3,885,599 which comprises an orbiting scroll member including an end plate and a wrap of an involute or substantially involute form located in an upright position on the surface of the end plate and a stationary scroll member including an end plate, a wrap of the same construction as that of the orbiting scroll member and an outlet port, the orbiting scroll member and the stationary scroll member being arranged in contact with each other with the respective wraps in meshing engagement with each other and the two scroll members housed in the interior of a housing formed with a suction port. An Oldham's ring is interposed between the orbiting scroll member and the housing or the stationary scroll member to keep the orbiting scroll member from rotating on its own axis, and a crank shaft is in engagement with the orbiting scroll member for moving the orbiting scroll member in orbiting movement while keeping same from apparently rotating on its own axis, so as to cause a fluid in sealed spaces defined between the two scroll members to perform a pumping action or to supply pressure fluid through the exhaust port to expand the pressure fluid to impart a force of rotation to the crank shaft. In, for example, U.S. Pat. No. 4,065,299 and Japanese Patent Application Laid-Open No. 148994/80, a scroll fluid apparatus is provided wherein the elements are located in a sealed vessel.

In the scroll fluid apparatus of the construction wherein the elements thereof are located in a sealed vessel, a crank shaft is generally arranged vertically and includes a shaft portion and a crank portion. The shaft portion is journalled by two upper and lower bearings while the crank shaft is engaged in a plain bearing provided to the orbiting scroll member. A device for feeding lubricant to these bearings usually comprises oil feeding passages formed in the crank shaft for supplying, by centrifugal forces, the bearing lubricant stored in the lower portion of the sealed vessel.

In the case of a scroll fluid apparatus comprising an intermediate chamber having an internal pressure which is intermediate in level between the suction pressure and the exhaust pressure located between the undersurface of the orbiting scroll member and a frame supporting the shaft portion of the crank shaft as disclosed in Japanese Patent Application Laid-Open No. 148994/80, the aforesaid oil feeding device has been found to have some disadvantages. For example, the pressure in the intermediate chamber affects the operation of the oil feeding device, so that variations are caused to occur in the volume of lubricants fed to the plain bearings. More specifically, the volume of lubricant fed to the plain bearing of the orbiting scroll member and the upper bearing of the shaft portion differs from the volume of lubricant fed to the lower bearing of the shaft portion. The result of this is that each bearing is unable to produce a lubricant film reaction commensurate with the load applied by the fluid pressure, thereby causing wear and seizure to occur.

SUMMARY OF THE INVENTION

An object of the invention is to provide an oil feeding device for scroll fluid apparatus capable of avoiding wear and seizure of bearings journalling the crank shaft of the apparatus.

Another object of the present invention is to provide an oil feeding device for scroll fluid apparatus capable of supplying lubricant to each bearing in optimum volume to enable a suitable lubricant film reaction to be produced in each bearing.

Still another object of the invention is to provide an oil feeding device for scroll fluid apparatus capable of avoiding a loss of pressure and a rise in the temperature of lubricant which might otherwise be caused by agitation of the lubricant in the intermediate chamber by the balance weight of the crank shaft.

The outstanding characteristic of the invention is that, in a scroll fluid apparatus including a stationary scroll member and an orbiting scroll member arranged in the usual combination wherein the orbiting scroll member has connected thereto a crank portion of a crank shaft which is journalled by plain bearings, axially extending oil flow passages are formed on the outer circumferential surface of the shaft at positions journalled by the plain bearings so that oil is supplied to the bearings and the flow resistances of the oil flow passages are varied, so as to supply lubricant to each bearing and have lubricant discharged therefrom in optimum volume to thereby cause a lubricant film of a suitable thickness to be produced in each bearing.

Additional and other objects, features and advantages of the invention will become apparent from the description set forth hereinafter when considered in conjunction with the accompanying drawings.

DETAILED DESCRIPTION OF THE PREFERRED EMBODIMENTS

Figure 1:
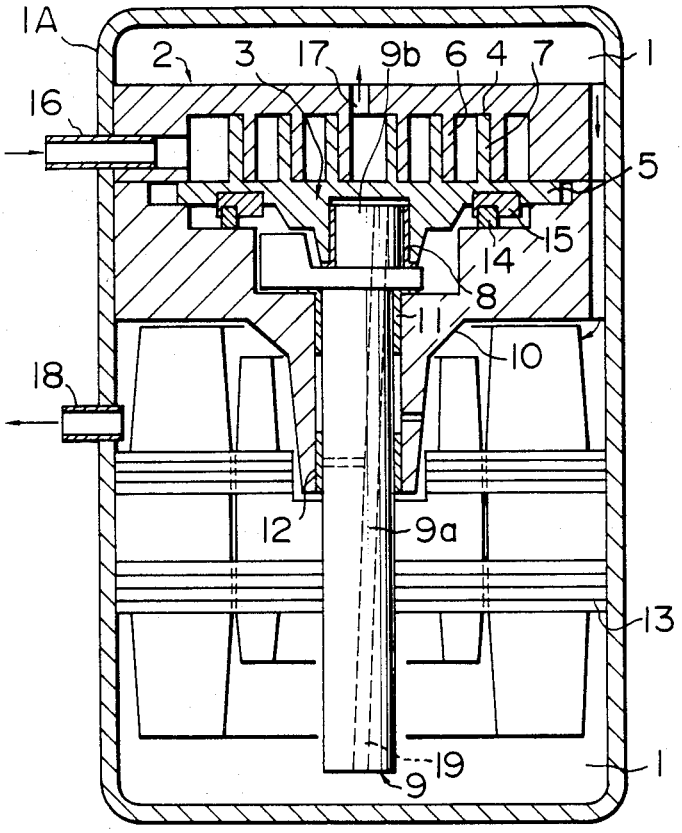
FIG. 1 is a vertical sectional view of a scroll fluid apparatus incorporating therein one embodiment of the oil feeding device according to the invention.

Preferred embodiments of the invention will now be described by referring to the drawings. In the embodiments described hereinafter, the scroll fluid apparatus will be described as functioning as a compressor.

In FIG. 1, a housing 1A defines a chamber 1 in which a stationary scroll member generally designated by the reference numeral 2 and an orbiting scroll member generally designated by the reference numeral 3 are disposed. The stationary scroll member 2 and orbiting scroll member 3 comprise disc-shaped end plates 4 and 5 and wraps 6 and 7 of the vortical form located in upright positions on the end plates 4 and 5, respectively. The end plates 4 and 5 are in contact with each other both facing inwardly, to bring the wraps 6 and 7 into meshing engagement with each other. The orbiting scroll member 3 has mounted on its undersurface a plain bearing 8 which is in engagement with a crank portion 9b of a crank shaft generally designated by the reference numeral 9 which is eccenrically located with respect to the center of a shaft portion 9a thereof. The shaft portion 9a is journalled by an upper plain bearing 11 and a lower plain bearing 12 mounted on a frame 10. The crank shaft 9 is driven for rotation by an electric motor 13. Rotation of the crank shaft 9 causes the orbiting scroll member 3 to move in orbiting movement through an Oldham's ring 14 and an Oldham's key 15 in such a manner that it is apparently kept from rotating on its own axis. Gas drawn by suction through a suction pipe 16 is compressed between the orbiting scroll member 3 and stationary scroll member 2 as the former moves in orbiting movement and discharged through an outlet port 17 into the chamber 1, from which the compressed gas is discharged through an exhaust pipe 18. As the fluid sealed between the two scroll members 2 and 3 is compressed, the pressure of the fluid applies a lateral force on the orbiting scroll member 3. This lateral force is applied to the crank portion 9b of the crank shaft 9 through the plain bearing 8 and then transmitted to the shaft portion 9a which is borne by the plain bearings 11 and 12. Formed in the crank shaft 9 is an eccentric oil feeding passage 19 in which the amount of eccentricity with respect to the center of the shaft portion 9a increases in going from a lower portion to an upper portion. The eccentric oil feeding passage 19 operates to draw oil in the bottom of the chamber 1 by centrifugal pumping action as the crank shaft 9 rotates and feeds same to the bearings 8, 11 and 12.

Figure 2:
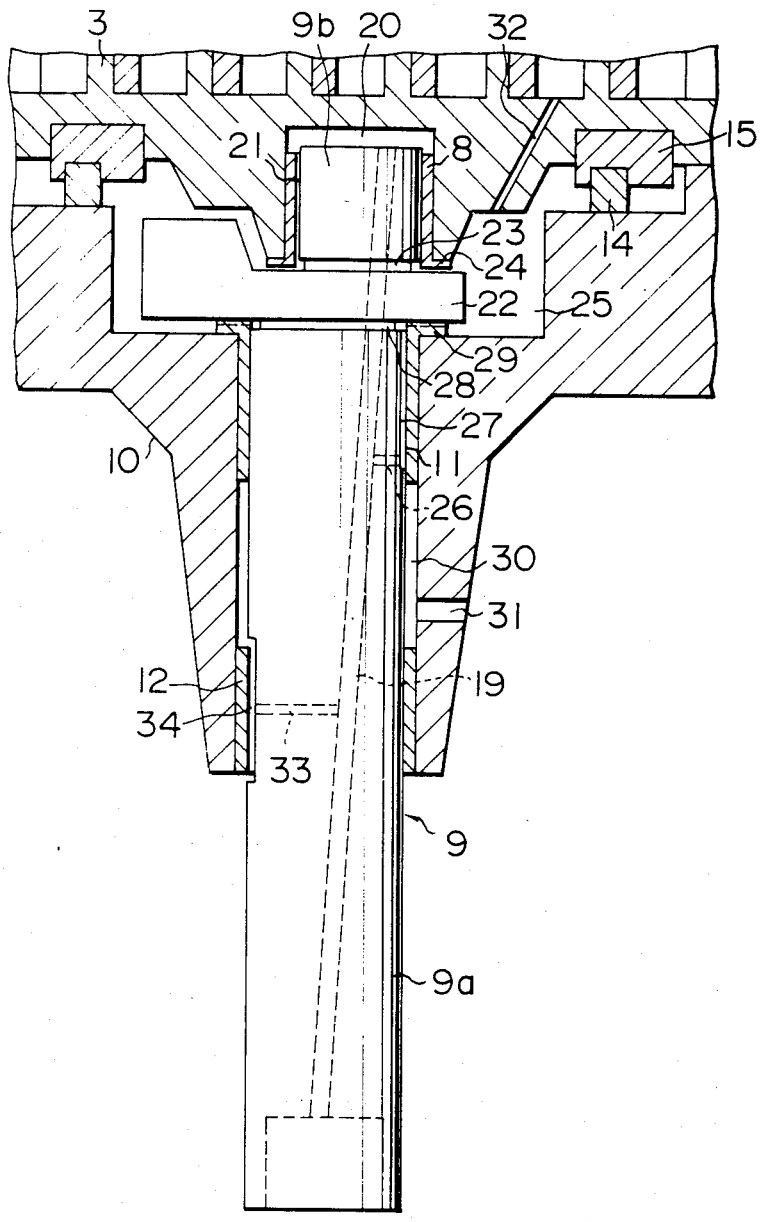
FIG. 2 is a vertical sectional view showing, on an enlarged scale, the crank shaft portion incorporating therein the oil feeding device comprising one embodiment of the invention.

The mechanism for feeding oil to the bearings 8, 11 and 12 will be described by referring to FIGS. 2 and 3. Oil is fed to the plain bearing 8 of the orbiting scroll member 3 as follows. The oil, drawn from the bottom of the chamber 1 by the centrifugal pumping action of the eccentric oil feeding passage 19, flows into an oil chamber 20 defined between the upper end of the crank portion 9b of the crank shaft 9 and the orbiting scroll member 3, from which the oil flows through a recessed oil flow passage 21 formed on the outer peripheral surface of the crank portion 9b of the crank shaft 9 to lubricate the plain bearing 8 of the orbiting scroll member 3 and the crank portion 9b. The oil that has lubricated the plain bearing 8 flows through an annular groove 23 formed in the junction of the crank portion 9b of the crank shaft 9 and a balance weight 22 to lubricate a thrust bearing 24 formed integrally with the plain bearing 8 in the lower portion thereof. Then the oil is released into an intermediate chamber 25 defined between the frame 10 and the orbiting scroll member 3.

To feed oil to the upper plain bearing 11 journalling the shaft portion 9a of the crank shaft 9, the oil in the bottom of the chamber 1 drawn by the eccentric oil feeding passage 19 is fed to an oil feeding duct 26 communicating with the eccentric oil feeding passage 19 and a recessed oil flow passage 27 extending axially and formed on the outer peripheral surface of the shaft portion 9a and communicating with the oil feeding duct 26. The oil that has lubricated the upper plain bearing 11 flows through an annular groove 28 formed in the junction of the shaft portion 9a and the balance weight 22 into a thrust bearing 29 formed integrally with the plain bearing 11 in the upper portion thereof. The oil is released into the intermediate chamber 25 after lubricating the thrust bearing 29. A portion of oil that has lubricated the upper plain bearing 11 is released from the lower end of the plain bearing 11 into an oil discharge chamber 30 defined by the shaft portion 9a, frame 10, plain bearing 11 and plain bearing 12. Then the oil is discharged from the oil discharge chamber 30 into the chamber 1 through an oil discharge duct 31.

The oil discharged into the intermediate chamber 25 flows through a fine duct 32 formed in the orbiting scroll member 3, to be discharged into the meshing portions of the scroll members 2 and 3. Thus the pressure in the intermediate chamber 25 is at a level intermediate between the discharge pressure and the suction pressure. Accordingly oil feeding to the upper plain bearing 11 and the plain bearing 8 of the orbiting scroll member 3 is carried out by the pressure differential between the discharge pressure and the intermediate pressure and the centrifugal pumping action of eccentric oil feeding passage 19.

To feed oil to the lower plain bearing 12 journalling the shaft portion 9a of the crank shaft 9, the oil, drawn by suction by the eccentric oil feeding passage 19 from the bottom of the chamber 1, is fed to an oil feeding duct 33 communicating with the eccentric oil feeding passage 19 and a recessed oil flow passage 34 extending axially and formed on the outer peripheral surface of the shaft portion 9a and communicating with the oil feeding duct 33. The oil that has lubricated the lower plain bearing 12 is released into the chamber 1 from the upper end of the bearing 12 through the oil discharge chamber 30 and oil discharge duct 31 and also from the lower end of the bearing 12.

Figure 3:
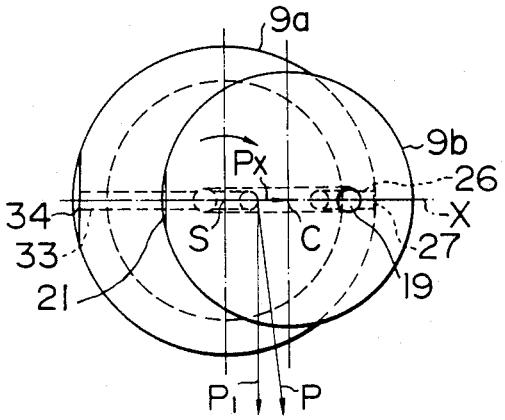
FIG. 3 is a plan view of the crank shaft, showing the relation between the oil flow passage and the direction in which a force caused by fluid pressure is applied.

Referring to FIG. 3, the recessed oil flow passages 21, 27 and 34 and the oil feeding ducts 26 and 33 are located on a line X connecting the center S of the shaft portion 9a of the crank shaft 9 and the center C of the crank portion 9b thereof. More specifically, the oil flow passage 21 is located in a position advanced by about 90 degrees with respect to a direction of a force P produced by the fluid in the sealed spaces; the oil flow passage 27 is located in a position displaced by 180 degrees with respect to the oil flow passage 21; and the oil flow passage 34 is located in a position displaced by 180 degrees with respect to the oil flow passage 27.

In FIG. 3, Px is a component of force of the force P in the X line direction, and $P_l$ is a component of force of the force P in a direction perpendicular to the X line. The oil flow passages 21 and 27 are constructed such that the resistance offered to the flow of oil by the passages 21 and 27 is higher than that offered thereto by the oil flow passage 34. To attain the end, the oil flow passages 21 and 27 may have their cross-sectional shapes reduced as compared with that of the oil flow passages 34. The cross-sectional shapes of the passages 21, 27 and 34 and their dimensions may be set by taking into consideration the facts that the oil feeding pressure for feeding oil to the oil flow passage 34 is obtained by the centrifugal pumping action of the eccentric oil feeding passage 19 and that the oil feeding pressure for feeding oil to the oil flow passage 21 and 27 is obtained from the pressure differential between the discharge pressure and the pressure in the intermediate chamber 25 and by the centrifugal pumping action of the eccentric oil feeding passage 19.

Operation of the embodiment of the oil feeding device shown and described hereinabove will be described.

Oil is fed to the plain bearings 8 and 11 through the oil flow passages 21 and 27 by the pressure differential between the pressure in the intermediate chamber 25 and the exhaust pressure and by the centrifugal pumping action of the eccentric oil feeding passage 19. The pressure differential between the oil feeding pressure and the pressure in the intermediate chamber 25 is over 1 kg/cm$^2$, for example. By this pressure differential, the oil from the oil flow passages 21 and 27 lubricates the plain bearings 8 and 11 and is released into the intermediate chamber 25. However, the volume of oil released into the intermediate chamber 25 in this way is restricted by the oil flow passages 21 and 27. In view of this, the oil stored in the intermediate chamber 25 never becomes excessive in volume due to the oil being released therefrom through the fine duct 32. Thus, no loss of pressure is caused by the agitating action of the balance weight 22, and the temperature of the oil in the intermediate chamber 25 is kept from rising. As a result, the minimum oil film thickness of the plain bearings 8 and 11 can be rendered optimum because no rise in the temperature of oil affects the plain bearings 8 and 11.

Meanwhile, the oil fed to the plain bearing 12 through the oil flow passage 34 only relies on the centrifugal pumping action of the eccentric oil feeding passage 19, so that the difference between the pressure for feeding oil thereto and the pressure for exhausting oil therefrom is very small and the oil fed thereto may sometime show a deficiency. This results in the oil flow passage 34 allowing oil to flow therethrough in volume greater than the oil flowing through the oil flow passages 21 and 27 in total, to thereby enable the volume of oil fed to the plain bearing 12 to be optimized.

The oil released into the intermediate chamber 25 as aforesaid flows through the fine duct 32 to the meshing portions of the two scroll members 2 and 3. Since the temperature of oil in the chamber 25 is kept from rising even if the balance weight 22 performs an agitating action, the gas drawn by suction into a space between the two scroll members 2 and 3 can have its temperature prevented from rising. Thus, an inordinate rise in the temperature of the discharge gas can be avoided, to thereby enable a reduction in the viscosity of oil concerned in the thickness of an oil film to be prevented.

Thus, by virtue of the aforesaid operation of the oil feeding means, it is possible to optimize the minimum thickness of the oil film of each of the plain bearings 8, 11 and 12, to thereby enabling seizure and wear to be effectively avoided.

In the embodiment described hereinabove, the oil flow passages 21, 27 and 34 are defined by flat surfaces formed by chamfering the crank and shaft portions of the crank shaft 9. However, the invention is not limited to this specific shape of the oil flow passages 21, 27 and 34. Suitable grooves may be formed on the peripheral surfaces of the crank and shaft portions to define the oil flow passages.

Figure 4:
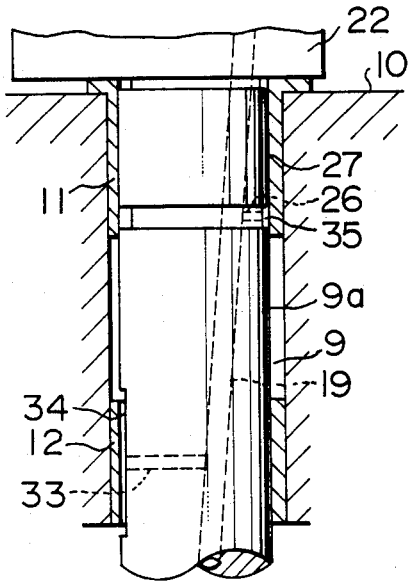
FIG. 4 is a vertical sectional view showing the oil feeding device comprising another embodiment of the invention.
Figure 5:
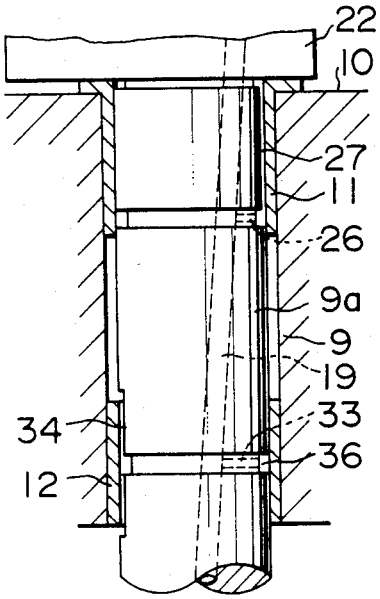
FIG. 5 is a vertical sectional view showing the oil feeding device comprising still another embodiment of the invention.

In order to increase the pressure of the oil film in each bearing and the cooling effect thereof, as shown in FIGS. 4 and 5, annular grooves 35 and 36 may be formed on the outer peripheral surface of the shaft portion 9*a* in positions in which the oil feeding passages 26 and 33 communicating with the eccentric oil passage 19 open in the oil flow passages 27 and 34, respectively. By this arrangement, oil can be fed from the annular grooves 35 and 36 in addition to the oil from the oil flow passages 27 and 34, thereby enabling the volume of fed oil to be increased and allowing increased results to be obtained in increasing the oil film pressure and bearing cooling effects. Alternatively, the annular grooves 35 and 36 may be formed on the bearing side.

Figure 6:
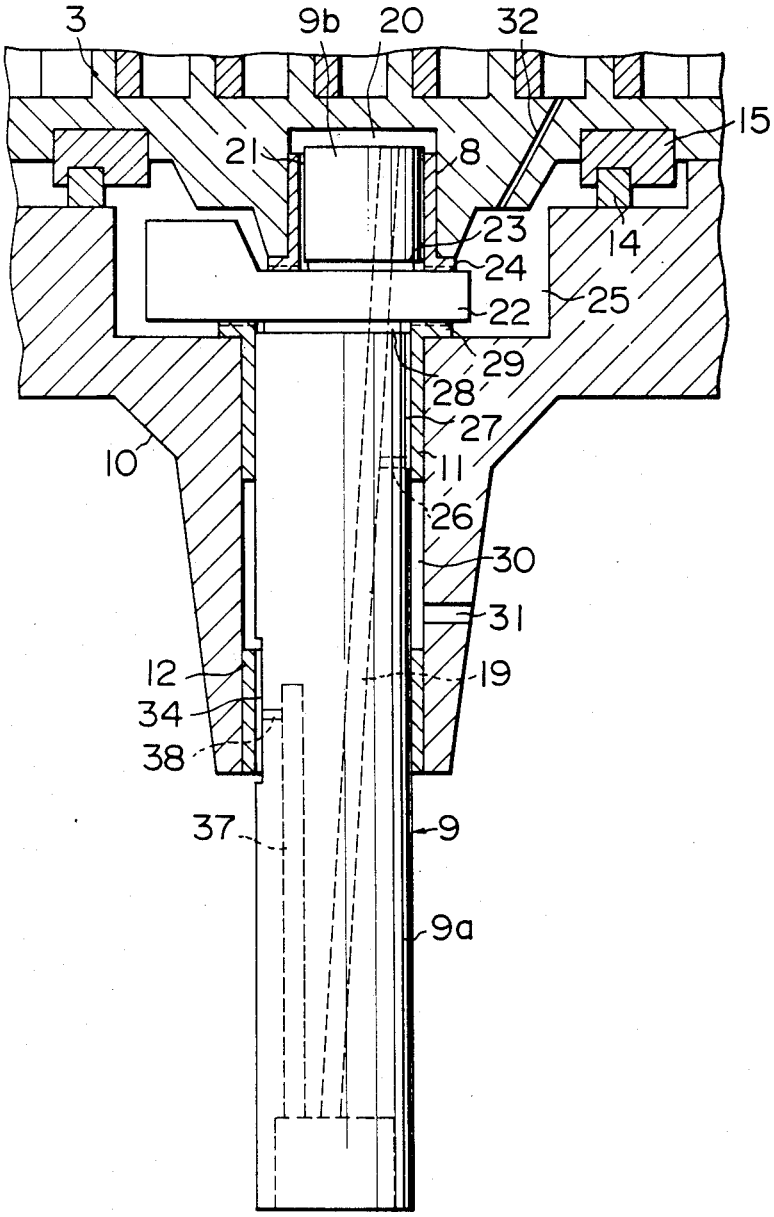
FIG. 6 is a vertical sectional view of the oil feeding device comprising a further embodiment of the invention.

In the embodiments shown and described hereinabove, oil is fed to the plain bearing 8 of the orbiting scroll member 3 by feeding oil from the oil chamber 20 in the upper portion of the crank portion 9*b* through the oil flow passage 21. However, an oil feeding passage communicating the eccentric oil feeding passage 19 with the oil flow passage 21 may be formed in the crank portion 9*b*. Also, to enable distribution of oil to be effected more aptly to the lower plain bearing 12 journalling the shaft portion 9*a* than to the other bearings, as shown in FIG. 6, an eccentric oil feeding passage 37 and an oil feeding duct 38 may be formed exclusively for the upper plain bearing 12 in the shaft portion 9*a*.

From the foregoing description, it will be appreciated that the present invention enables an optimum oil film thickness to be imparted to each bearing having a different oil feeding pressure. Thus, the bearings can be kept from undergoing seizure.

What is claimed is:

1. An oil feeding device for a scroll fluid apparatus including a stationary scroll member, an orbiting scroll member engaging said stationary scroll member for orbiting movement, a crankshaft for driving said orbiting scroll member for orbiting movement, a first plain bearing journalling a crank portion of said crankshaft, a second plain bearing and a third plain bearing for journalling a shaft portion of said crankshaft, and an intermediate chamber formed at the back of said orbiting scroll member and having a pressure intermediate between a discharge pressure and a suction pressure for receiving lubricant oil fed to said first and second plain bearings and released therefrom, characterized in that recessed oil flow passages are formed on an outer peripheral surface of said crankshaft at positions corresponding to said first, second and third plain bearings, respectively, and extending substantially axially with respect to the plain bearings, said recessed oil flow passages are located on the outer peripheral surface of said crankshaft in a position displaced from a line of action of a lateral force applied by fluid pressure in sealed spaces defined between said two scroll members, so as to offset a bearing oil film reaction produced in response to the lateral force;

a single passage formed in said crankshaft for feeding lubricant oil to said recessed oil flow passages;

said recessed oil flow passage for said third plain bearing has a lower resistance portion to the flow of fluid than said recessed oil flow passages for said first and second plain bearings; and at least two separate duct means formed in said crankshaft and communicating with the single passage for respectively feeding lubricant from said single passage to the recessed oil flow passages formed on the outer peripheral surfaces of the crankshaft at the positions corresponding to the second and third plain bearings.

2. An oil feeding device as claimed in claim 1, wherein an annular groove is formed on the outer peripheral surface of said crankshaft in a position corresponding to said second plain bearing and is adapted to communicate with said recessed oil flow passage for said second plain bearing.

3. An oil feeding device as claimed in one of claims 1 or 2, wherein said lower resistance portion has a larger cross sectional area than said recess oil flow passages for said first and second plain bearings.

4. An oil feeding device as claimed in one of claims 1 or 2, wherein said lower resistance portion has a larger axial length than said recessed oil flow passages for said first and second plain bearings.

* * * * *